US007023403B2

(12) United States Patent
Setoguchi et al.

(10) Patent No.: US 7,023,403 B2
(45) Date of Patent: Apr. 4, 2006

(54) PLASMA DISPLAY AND METHOD FOR DRIVING THE SAME

(75) Inventors: Noriaki Setoguchi, Higashimorokata (JP); Takahiro Takamori, Kawasaki (JP); Eiji Ito, Kawasaki (JP); Tomokatsu Kishi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 114 days.

(21) Appl. No.: 09/983,945

(22) Filed: Oct. 26, 2001

(65) Prior Publication Data

US 2002/0097200 A1 Jul. 25, 2002

(30) Foreign Application Priority Data

Jan. 19, 2001 (JP) ..... 2001-012419

(51) Int. Cl.
*G09G 3/28* (2006.01)

(52) U.S. Cl. ..... 345/60; 345/63

(58) Field of Classification Search ..... 345/55, 345/60, 67, 63, 89, 690; 315/169.1–169.4
See application file for complete search history.

(56) References Cited

U.S. PATENT DOCUMENTS 5,835,072 A * 11/1998 Kanazawa ..... 345/60
6,023,258 A * 2/2000 Kuriyama et al. ..... 345/60
6,034,482 A * 3/2000 Kanazawa et al. ..... 315/169.4
6,107,978 A * 8/2000 Nagaoka et al. ..... 345/60
6,198,463 B1 3/2001 Ito et al.
6,232,935 B1 * 5/2001 Fukushima et al. ..... 345/67
6,356,261 B1 3/2002 Kim ..... 345/209
6,369,514 B1 * 4/2002 Awamoto ..... 315/169.1
6,373,451 B1 * 4/2002 Kang et al. ..... 345/60
6,531,995 B1 3/2003 Ishii et al.
2003/0174105 A1 * 9/2003 Kanazawa ..... 345/63
2005/0078061 A1 * 4/2005 Kim et al. ..... 345/63

FOREIGN PATENT DOCUMENTS

CN 1157449 A 8/1997
CN 1224211 A 7/1999
EP 0 762 373 3/1997
EP 0 810 577 A1 12/1997
EP 0 964 383 A1 12/1999
EP 1 065 650 A2 1/2001
EP 001365381 A2 * 11/2003
KR 2000-0061883 10/2000

* cited by examiner

*Primary Examiner*—Amare Mengistu
(74) *Attorney, Agent, or Firm*—Staas & Halsey LLP

(57) ABSTRACT

A plasma display includes address electrodes for scanning and addressing display cells, and scan electrodes for establishing an address discharge between the address electrodes and the scan electrodes by addressing. The display also includes common electrodes for establishing a sustain discharge between the scan electrodes and the common electrodes to display an image at the display cells, and a scan driver for supplying a voltage to the scan electrodes so as to scan display cells upon addressing during divided periods. Upon addressing, the scan driver varies the potential of a scan electrode adjacent to the scan electrode that corresponds to the addressed address electrode.

17 Claims, 8 Drawing Sheets

Aj
Y2
X3
Y3
X4
Y4
GND
1/2Vs
-1/2Vs
Va
401
402
403
404
405
411
412
413
414
415
Vw
NON-SELECTED ELECTRODE
SELECTED ELECTRODE
NON-SELECTED ELECTRODE
Re:Ta1
Ts
Ta2
Ta1
Ta
Tr

Aj
Y2
X3
Y3
X4
Y4
GND
1/2Vs
-1/2Vs
Va
606
601
602
611
612
613
603
614
604
607
605
615
Vw
NON-SELECTED ELECTRODE
SELECTED ELECTRODE
NON-SELECTED ELECTRODE
Re:Ta1
Ts
Ta2
Ta1
Ta
Tr

PLASMA DISPLAY AND METHOD FOR DRIVING THE SAME

CROSS-REFERENCE TO RELATED APPLICATIONS

This application is based upon and claims priority of Japanese Patent Application No. 2001-012419, filed on Jan. 19, 2001, the contents being incorporated herein by reference.

BACKGROUND OF THE INVENTION

1. Field of the Invention The present invention relates to plasma displays and methods for driving the plasma displays.

2. Description of the Related Art

FIG. 1 illustrates a basic configuration of a plasma display device. A control circuit portion 101 controls an address driver 102, a common electrode (X electrode) sustain circuit 103, a scan electrode (Y electrode) sustain circuit 104, and a scan driver 105.

The address driver 102 supplies a predetermined voltage to address electrodes A1, A2, A3, . . . . Hereinafter, one or each of the address electrodes A1, A2, A3, . . . will be generally termed an address electrode Aj, where "j" is a suffix.

The scan driver 105 supplies a predetermined voltage to scan electrodes Y1, Y2, Y3, . . . in accordance with the control of the control circuit portion 101 and the scan electrode sustain circuit 104. Hereinafter, one or each of the scan electrodes Y1, Y2, Y3, . . . will be generally termed a scan electrode Yi, where "i" is a suffix.

The common electrode sustain circuit 103 supplies the same voltage to each of the common electrodes X1, X2, X3, . . . . Hereinafter, one or each of the common electrodes X1, X2, X3, . . . will be generally termed a common electrode Xi, where "i" is a suffix. The common electrodes Xi are connected to each other and at the same voltage level.

In a display area 106, the scan electrodes Yi and the common electrodes Xi form rows that extend horizontally, and the address electrodes Aj form columns that extend vertically. The scan electrodes Yi and the common electrodes Xi are alternately disposed in a vertical direction.

The scan electrodes Yi and the address electrodes Aj forms a two-dimensional matrix with i rows and j columns. The intersection of a scan electrode Yi and an address electrode Aj, and the adjacent common electrode Xi associated with the electrodes form a display cell Cij. The display cell Cij corresponds to a display pixel, thus making it possible to display a two-dimensional image in the display area 106.

FIG. 2A illustrates a display cell Cij of FIG. 1. The common electrodes Xi and the scan electrodes Yi are formed on a front glass substrate 211. On the top thereof, a dielectric layer 212 for insulating the electrodes from a discharge space 217 is deposited. Furthermore, on the top of the dielectric layer 212, an MgO (magnesium oxide) protective film 213 is deposited.

On the other hand, the address electrodes Aj are formed on a rear glass substrate 214 disposed so as to oppose to the front glass substrate 211. On the top of the address electrodes Aj, a dielectric layer 215 is deposited, on the top of which phosphor is deposited. Gas such as Ne+Xe Penning gas is sealed in the discharge space 217 between the MgO protective film 213 and the dielectric layer 215.

FIG. 2B is for explaining the capacitance Cp of an AC-driven plasma display. A capacitance Ca is the capacitance of the discharge space 217 between the common electrode Xi and the scan electrode Yi. A capacitance Cb is the capacitance of the dielectric layer 212 between the common electrode Xi and the scan electrode Yi. A capacitance Cc is the capacitance of the front glass substrate 211 between the common electrode Xi and the scan electrode Yi. The total of these capacitances Ca, Cb and Cc determines the capacitance between the electrodes Xi and Yi.

FIG. 2C is for explaining light emission of an AC driven plasma display. An array of red, blue, and green phosphors 218 is deposited on the inner surface of ribs 216 in the shape of a stripe for each color. A discharge between a common electrode Xi and a scan electrode Yi is adapted to excite the phosphor 218 to emit light 221.

FIG. 3 illustrates the structure of a frame FR of an image. For example, an image is formed at a rate of 60 frames per second. One frame FR consists of a first sub-frame SF1, a second sub-frame SF2, . . . , and an n-th sub-frame SFn, where n is equal to 10, for example, and corresponds to the number of gray scale bits. Hereinafter, one or each of the sub-frames SF1, SF2, . . . , SFn will be generally termed a sub-frame SF.

Each sub-frame SF consists of a reset period Tr, an address period Ta, and a sustain period Ts. During the address period Ta of each sub-frame SF, it is possible to select an "on" state or an "off" state of each display cell. The cell selected emits light during the sustain period Ts. Each sub-frame SF provides a different number of light emissions (time). This makes it possible to determine a gray scale level.

In the above construction, all the display lines corresponding to the scan electrodes Yi are sequentially scanned and addressed during the address period Ta; however, such a method can also be contemplated by which all the display lines are subdivided for scanning during the address period Ta. This method will be described below.

FIG. 4 illustrates a timing chart of a method for driving a plasma display by dividing the address period Ta into two. The address period Ta is divided into the first half address period Ta1 and the second half address period Ta2. The first half address period Ta1 is a period during which odd-numbered scan electrodes (odd-numbered lines) such as Y3 are scanned sequentially and addressed. The second half address period Ta2 is a period during which even-numbered scan electrodes (even-numbered lines) such as Y2 and Y4 are scanned sequentially and addressed.

First, during the reset period Tr, a predetermined voltage is applied between each scan electrode Yi and each common electrode Xi for full writing and full erasing with charges. In this way, the contents of the previous display are erased and predetermined wall charges are formed.

Next, during the first half address period Ta1, upon applying a pulse of positive potential Va to the address electrode Aj, the odd-numbered scan electrodes such as Y3 are scanned sequentially to apply thereto a negative potential pulse 403 of −Vs/2 (V). At this time, the potential of each electrode is shown in FIG. 5.

FIG. 5 illustrates the potential of each scan electrode when the scan electrode Y3 is scanned and addressed. The scan electrode Y2 is in a non-selected state at a positive potential 401 of +Vs/2 (V). The common electrode X3 is also at a positive potential 402 of +Vs/2 (V). The scan electrode Y3 is addressed to be in a selected state at a negative potential 403 of −Vs/2 (V). The common electrode X4 is at the ground potential 404. The scan electrode Y4 is in a non-selected state at a positive potential 405 of +Vs/2 (V). A positive potential Va is applied to the address electrode Aj.

In general, an address discharge 501 first occurs between the address electrode Aj and the scan electrode Y3. After this, by being triggered by the address discharge 501, a surface discharge 502 occurs between the scan electrode Y3 and the corresponding adjacent common electrode X3. This causes wall charges opposite in polarity to the applied voltage to be formed on each electrode. The wall charges cause a sustain discharge to occur between the common electrode X3 and the scan electrode Y3 during the subsequent sustain period Ts of FIG. 4, leading to a light emission.

Since the scan electrode Y2 is at the positive potential 401, the address discharge 501 causes a horizontal discharge 503 to occur. The discharge 503 extends horizontally to reach the scan electrode Y2. Consequently, the wall charges of the address electrode on the scan electrode Y2 are erased, thereby making it difficult to address the scan electrode Y2 during the subsequent second half address period Ta2. That is, wall charges cannot stably be formed on the even-numbered scan electrodes such as Y2 during the second half address period Ta2, thereby making it impossible to display stable images.

In this context, such a method may be contemplated by which the scan electrode Y2 is fixed to the ground potential during an address period Ta1. However, by the fixture, during the address period Ta1, the wall charges formed during the reset period Tr cannot be sustained, thereby raising a problem of making it impossible to address the scan electrode Y2. That is, a weak discharge is produced from the address electrode Aj to the scan electrode Y2, thereby causing the wall charges on the scan electrode Y2 to be cancelled. The weak discharge makes it difficult to address the scan electrode Y2 during the second half address period Ta2. The weak discharge depends in magnitude largely on temperature; the higher the temperature of the plasma display panel is, the larger the weak discharge is. This makes addressing more difficult.

Incidentally, during the second half address period Ta2 of FIG. 4, upon applying a pulse of positive potential Va to the address electrode Aj, pulses 411 and 415 of negative potential −Vs/2 (V) are applied by sequential scanning to the even-numbered scan electrodes such as Y2 and Y4. At this time, potentials 412, 413 and 414 are applied to the electrodes X3, Y3 and X4, respectively. This allows the even-numbered scan electrodes Y1 and Y4 to be addressed.

During the sustain period Ts, a voltage opposite in phase is applied between each common electrode Xi and each scan electrode Yi to establish a sustain discharge and emit light between the scan electrode Yi and the common electrode Xi corresponding to the display cell addressed during the address period Ta.

SUMMARY OF THE INVENTION

It is an object of the present invention to provide a plasma display and a method for driving the plasma display which can produce a stable address discharge during an address period and stably sustain wall charges formed during a reset period.

The present invention provides a plasma display including an address electrode for scanning and addressing a plurality of display cells, and a scan electrode for establishing an address discharge between the address electrode and the scan electrode by addressing. The plasma display also includes a common electrode for establishing a sustain discharge between the scan electrode and the common electrode to display an image at the display cells, and a scan driver for supplying a voltage to the scan electrode so as to scan a plurality of display cells upon addressing during a plurality of divided periods. Upon addressing, the scan driver varies the potential of a scan electrode adjacent to a scan electrode corresponding to the addressed address electrode.

Since the potential of the neighboring scan electrode is varied upon addressing, it is possible to vary the potential between a period for producing an address discharge and another period, during the address period. The potential is lowered during the address discharge period but increased during the other period. This makes it possible to produce a stable address discharge and stably sustain the wall charges formed during a reset period.

DETAILED DESCRIPTION OF THE PREFERRED EMBODIMENTS

Figure 1:
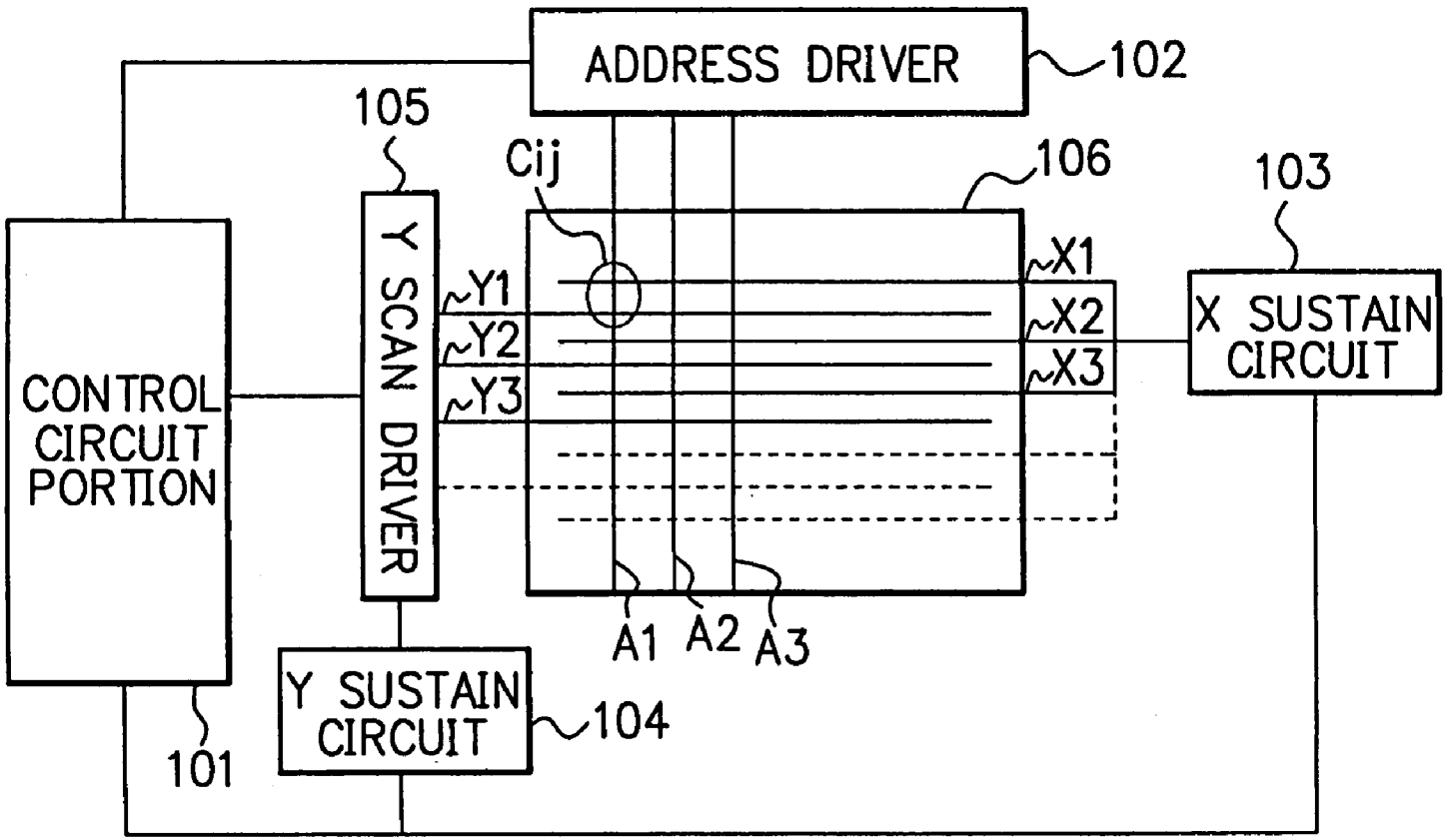
FIG. 1 (PRIOR ART)
FIG. 1 is a block diagram illustrating a basic configuration of a plasma display device.
Figure 2A:
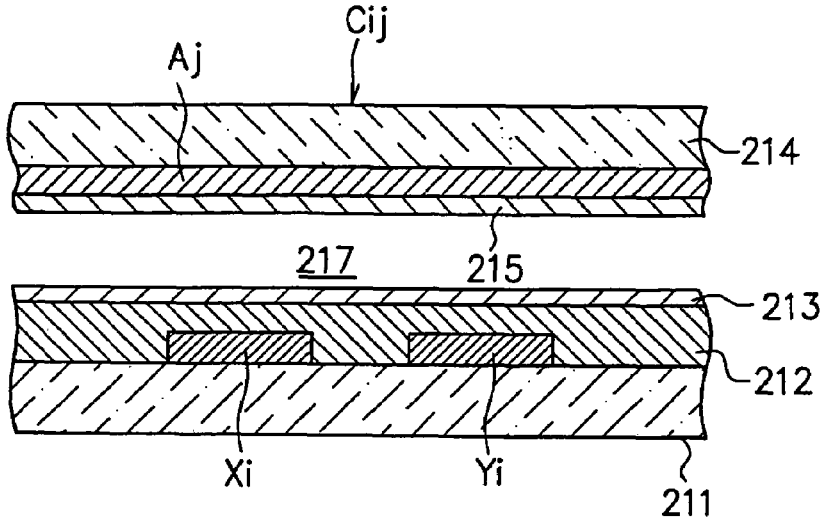
FIG. 2A (PRIOR ART)
FIGS. 2A to 2C are sectional views of a display cell of a plasma display.
Figure 2B:
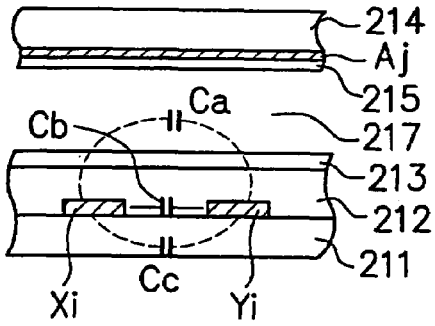
FIG. 2B (PRIOR ART)
Figure 2C:
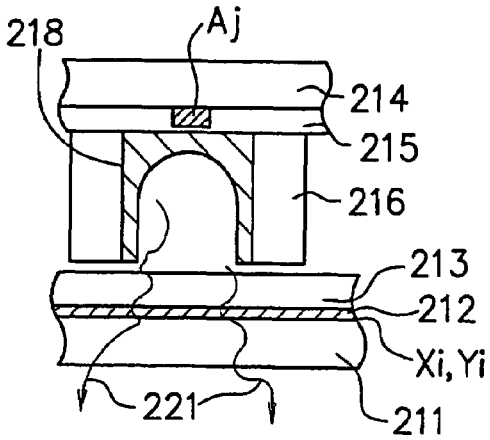
FIG. 2C (PRIOR ART)
Figure 3:
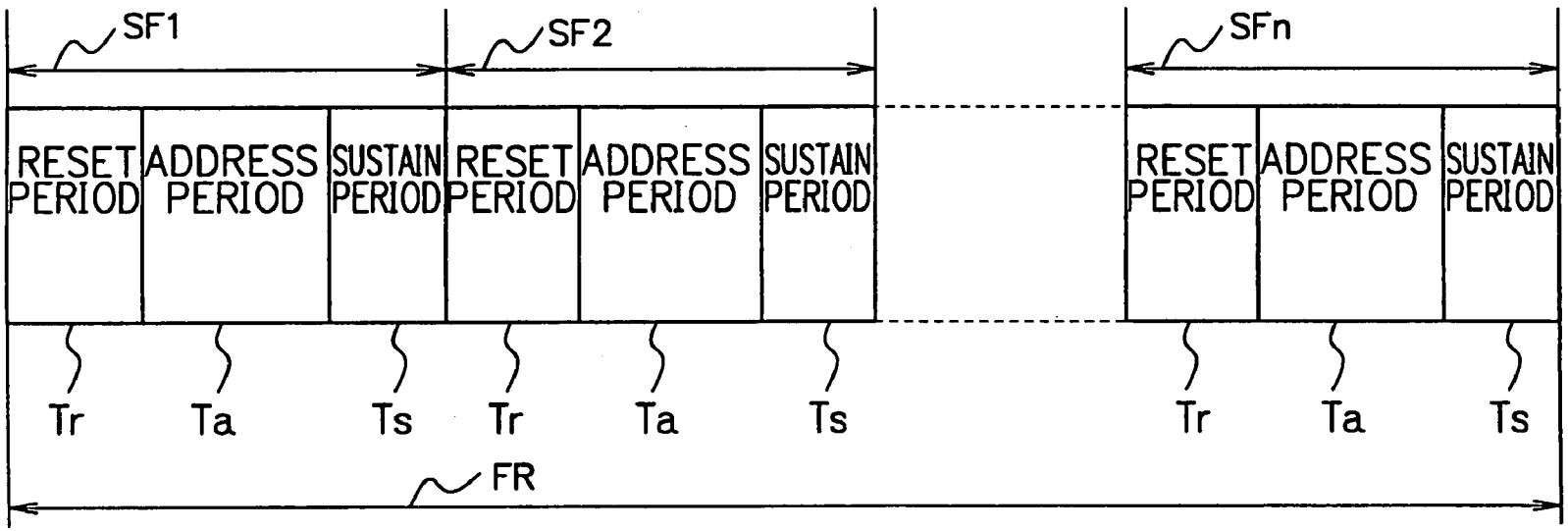
FIG. 3 (PRIOR ART)
FIG. 3 illustrates the structure of a frame of an image.
Figure 4:
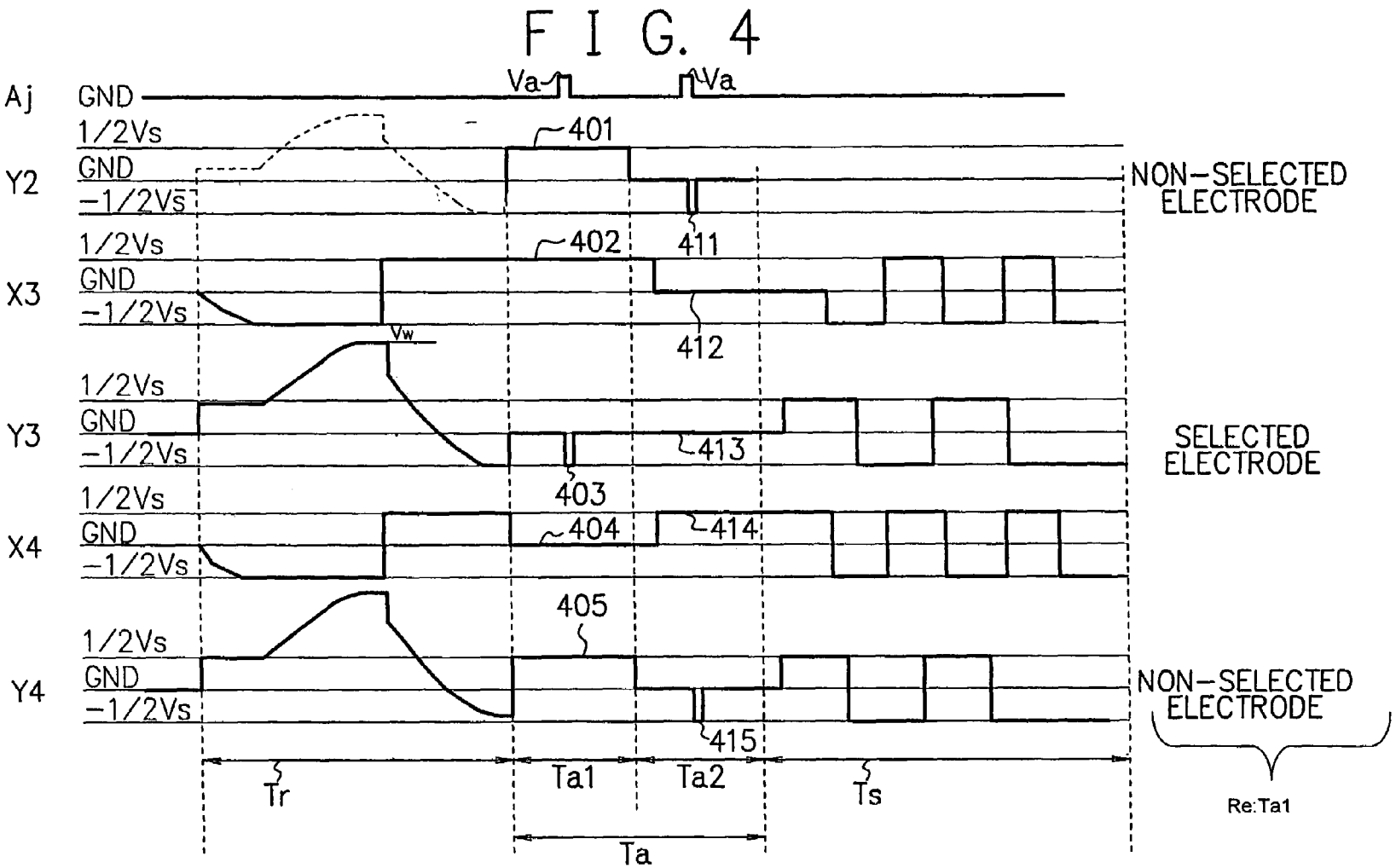
FIG. 4 is a waveform chart for driving a plasma display.

A plasma display panel according to an embodiment of the present invention has a configuration shown in FIGS. 1 and 2, and forms a frame shown in FIG. 3.

Figure 6:
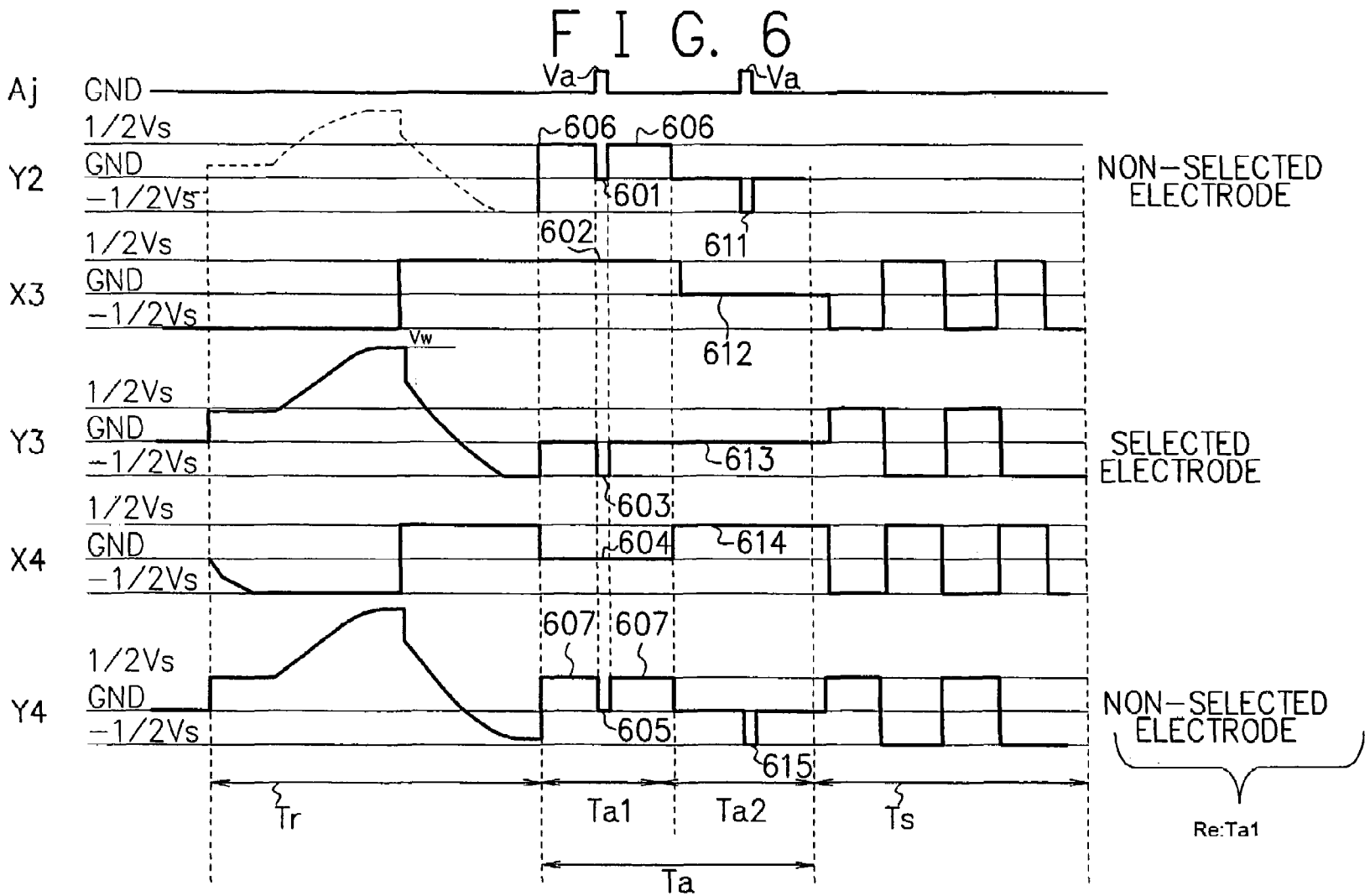
FIG. 6 is a waveform chart for driving a plasma display according to an embodiment of the present invention.

FIG. 6 illustrates a timing chart of a method for driving the plasma display according to this embodiment. An address period Ta is divided into the first half address period Ta1 and the second half address period Ta2. The first half address period Ta1 is a period during which odd-numbered scan electrodes (odd-numbered lines) such as Y3 are scanned sequentially and addressed. The second half address period Ta2 is a period during which even-numbered scan electrodes (even-numbered lines) such as Y2 and Y4 are scanned sequentially and addressed.

First, during the reset period Tr, a predetermined voltage is applied between each scan electrode Yi and each common electrode Xi for full writing and full erasing with charges. In this way, the contents of the previous display are erased and predetermined wall charges are formed.

Next, during the first half address period Ta1, upon applying a pulse of positive potential Va to the address electrode Aj, the odd-numbered scan electrodes such as Y3 are scanned sequentially to apply thereto a negative potential pulse 603 of −Vs/2 (V).

Upon addressing the scan electrode such as Y3, the potential of the neighboring scan electrodes such as Y2 and Y4 is varied. The address period Ta1 is divided into a period for establishing an address discharge and another period. The potential of the neighboring scan electrodes such as Y2 and Y4 is reduced to a low ground potential 601, 605 during the address discharge period, and to a high positive potential 606, 607 during the other period. This makes it possible to establish a stable address discharge and sustain the stable wall charges formed during the reset period Tr.

Figure 7:
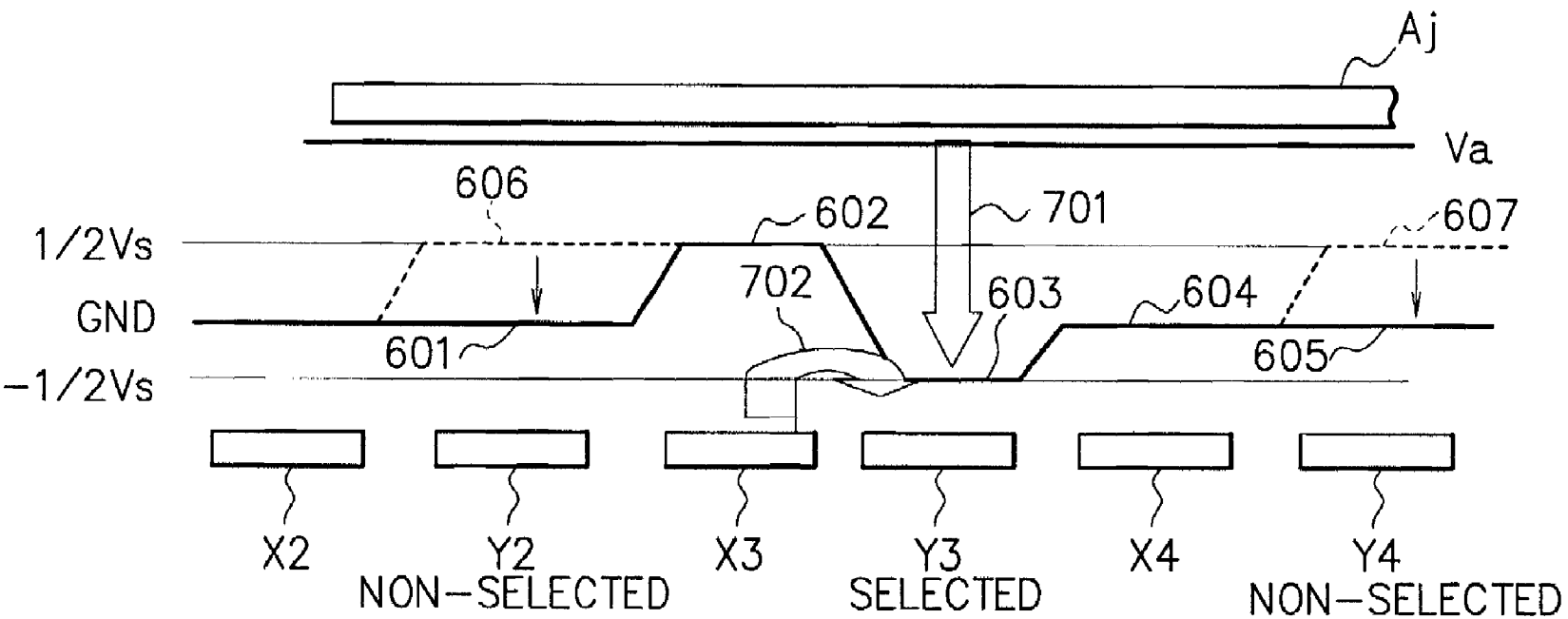
FIG. 7 is a schematic view for explaining a he potential of a scan electrode of FIG. 6 upon scanning.

FIG. 7 is for explaining the potential of each electrode when a pulse of positive potential Va is applied to the address electrode Aj during the first half address period Ta1 to scan and address the scan electrode Y3. The scan electrode Y2 is in a non-selected state and brought to the ground potential 601 from the positive potential 606 of +Vs/2 (V). The common electrode X3 is at a positive potential 602 of +Vs/2 (V). The scan electrode Y3 is addressed to be in a selected state at the negative potential 603 of −Vs/2 (V). The common electrode X4 is at the ground potential 604. The scan electrode Y4 is in a non-selected state and brought to the ground potential 605 from the positive potential 607 of +Vs/2 (V). The positive potential Va is applied to the address electrode Aj.

Figure 5:
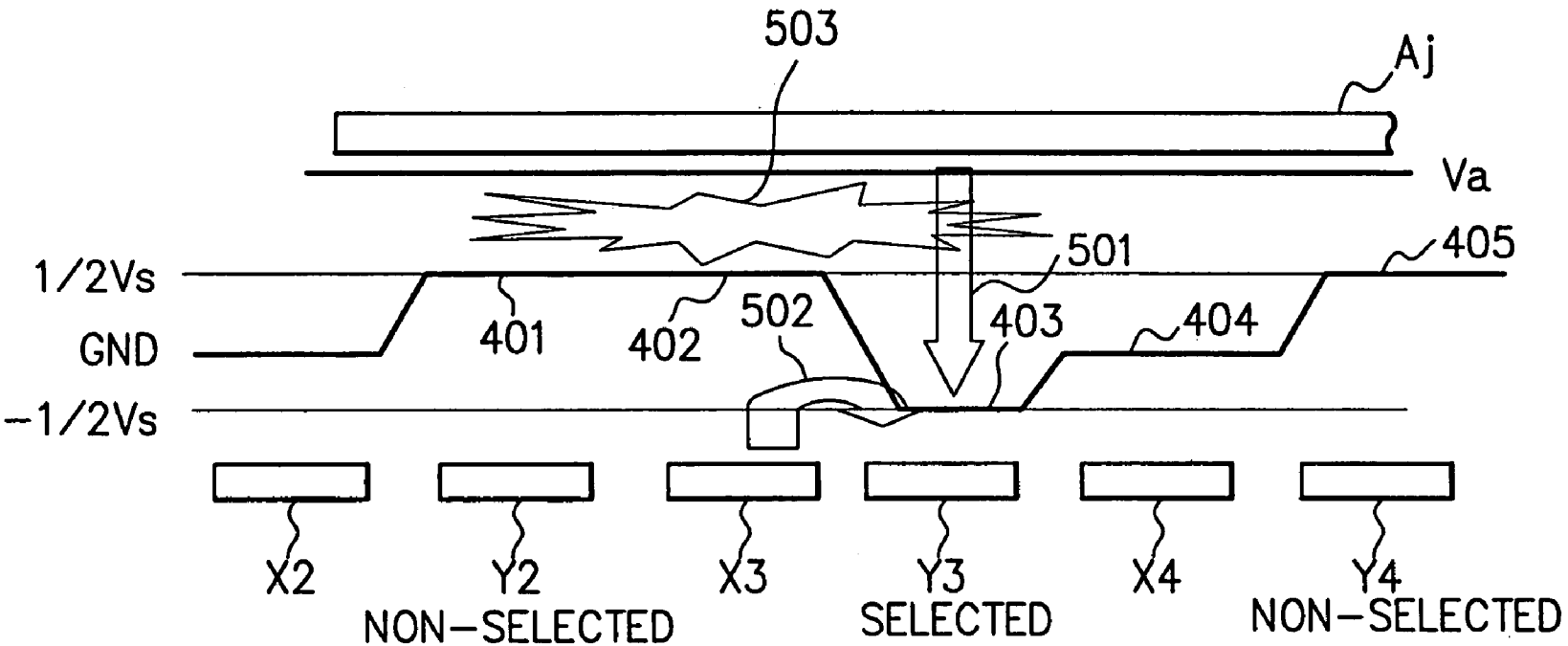
FIG. 5 (PRIOR ART)
FIG. 5 is a schematic view for explaining a potential of a scan electrode of FIG. 4 upon scanning.

Since the scan electrodes Y2 and Y4, adjacent to the scan electrode Y3 to be addressed, are at the ground potential 601, 605, a stable address discharge 701 occurs between the address electrode Aj and the scan electrode Y3. In FIG. 5, the scan electrode Y2 at the high potential 401 causes the wasted discharge 503 extending horizontally to occur in conjunction with the address discharge 501. In this embodiment, since the scan electrode Y2 is lowered to the ground potential 601, the discharge 503 is not produced in a horizontal direction but the stable address discharge 701 is produced. That is, in FIG. 5, the discharge 503 causes the wall charges of the address electrode on the scan electrode Y2 to be erased, thereby making addressing difficult during the subsequent second half address period Ta2. However, in this embodiment, the wall charges of the address electrode on the scan electrode Y2 are not erased, thereby making it possible to stably address the scan electrode Y2 during the subsequent second half address period Ta2.

Next, by being triggered by the address discharge 701, a surface discharge 702 occurs between the scan electrode Y3 and the corresponding adjacent common electrode X3. This causes wall charges opposite in polarity to the applied voltage to be formed on each electrode. The wall charges cause a sustain discharge to occur between the common electrode X3 and the scan electrode Y3 during the subsequent sustain period Ts of FIG. 6, leading to a light emission.

According to this embodiment, the potential of neighboring scan electrodes such as Y2 and Y4 are lowered to the ground potential, whereby a stable address discharge can be established. This allows stable wall charges to be formed during the address period Ta and provides a stable display during the sustain period Ts.

Incidentally, such a question arises that lowering the potential of the neighboring scan electrodes such as Y2 and Y4 to the ground potential during the address period Ta1 would make it impossible to sustain, during the address period Ta1, the wall charges formed during the reset period Tr.

In this embodiment, as shown in FIG. 6, during the address period Ta1, the neighboring scan electrodes such as Y2 and Y4 are brought to the ground potential 601, 605 only during the addressing (address discharge) period, and brought to the positive potential 606, 607 of +Vs/2 (V) during the other period. This makes it possible to sustain the stable wall charges formed during the reset period Tr and stably address the even-numbered scan electrodes such as Y2 and Y4 during the subsequent second half address period Ta2.

The odd-numbered scan electrodes such as Y3 have been already addressed during the first half address period Ta1. Thus, during the second half address period Ta2, the wall charges formed during the reset period Tr need not be sustained but only the odd-numbered scan electrodes such as Y3 suffice to be sustained at the ground potential 613.

That is, during the second half address period Ta2, upon applying a pulse of positive potential Va to the address electrode Aj, pulses 611 and 615 of negative potential −Vs/2 (V) are applied to the even-numbered scan electrodes such as Y2 and Y4 by sequential scanning. At this time, the scan electrodes such as Y3 adjacent to the addressed even-numbered scan electrodes such as Y2 and Y4 are fixed to the ground potential 613. Since the scan electrode Y3 corresponding to the common electrode X3 is not in a selected state, the common electrode X3 is brought to the ground potential 612. Since the scan electrode Y4 corresponding to the common electrode X4 is in a selected state, the common electrode X4 is brought to a positive potential 614 of +Vs/2 (V). Thus, during the second half address period Ta2, like in the first half address period Ta1, an address discharge is established between the even-numbered scan electrodes such as Y2 and Y4 and the address electrode Aj. A surface discharge, triggered by this, is then produced between the even-numbered scan electrodes such as Y2 and Y4 and the corresponding adjacent even-numbered common electrodes such as X2 and X4. This allows wall charges to be formed.

Subsequently, during the sustain period Ts, a voltage opposite in phase is applied between each common electrode Xi and each scan electrode Yi to establish a sustain discharge and emit light between the scan electrodes Yi and the common electrodes Xi corresponding to the display cell addressed during the address period Ta.

In the foregoing, such a case has been explained in which the address period Ta is divided into two address periods Ta1 and Ta2; however, the address period Ta may be divided into three or more.

Figure 8:
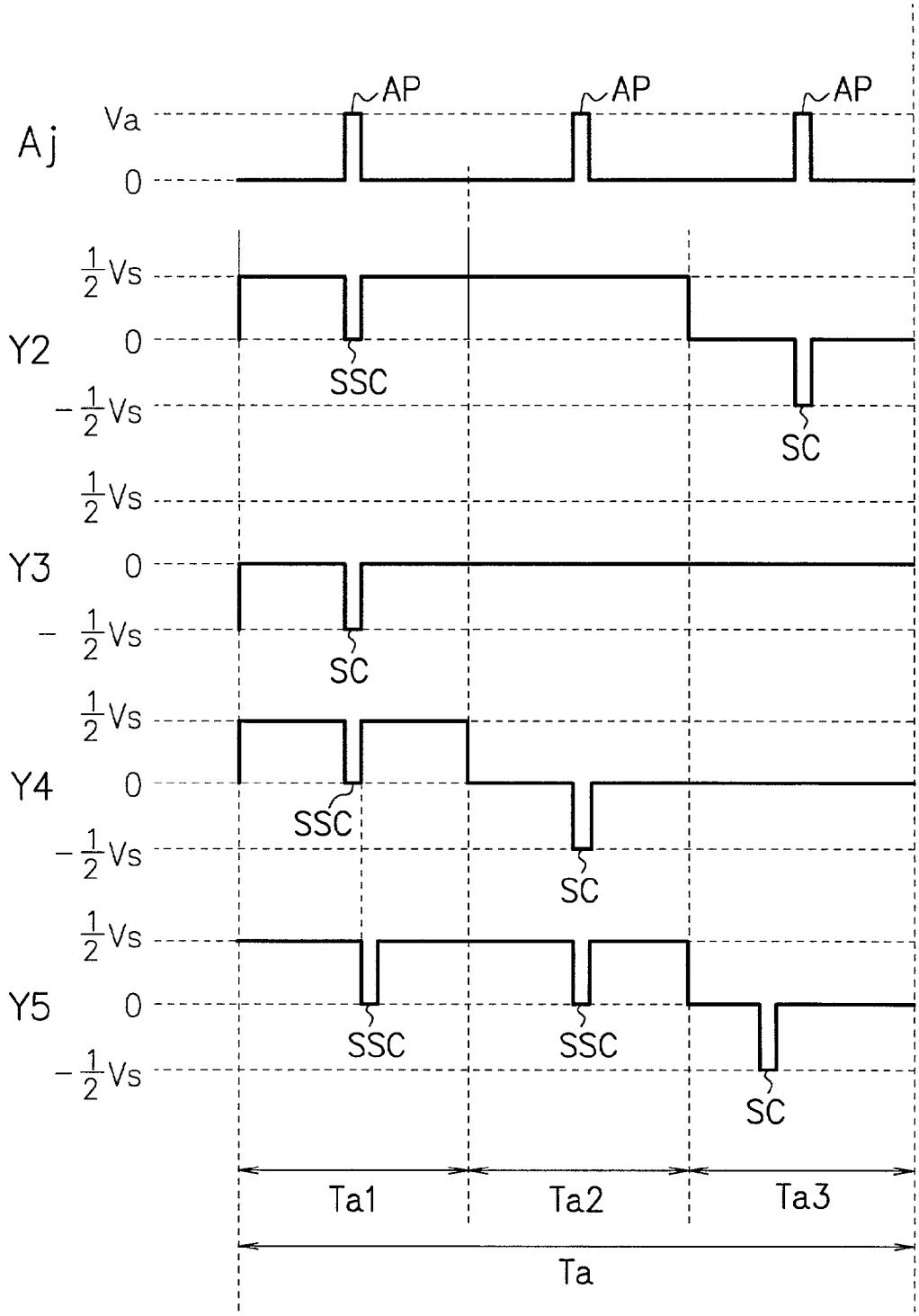
FIG. 8 is a waveform chart during an address period split into three.

FIG. 8 illustrates a timing chart for a case where the address period Ta is divided into three, upon addressing, and a voltage is applied to the scan electrodes to scan display cells. Although only the address period Ta is illustrated, the reset period Tr and the sustain period Ts are the same as in FIG. 6.

The address period Ta is divided into the first address period Ta1, the second address period Ta2, and the third address period Ta3. The first address period Ta1 is a period during which the scan electrodes such as Y3 are addressed. The second address period Ta2 is a period during which the scan electrodes such as Y4 are addressed. The third address period Ta3 is a period during which the scan electrodes such as Y2 and Y5 are addressed.

During the first address period Ta1, upon applying a pulse AP of positive potential Va to the address electrode Aj, a scan pulse SC is sequentially applied to the scan electrodes such as Y3 for addressing. The scan pulse SC is a pulse which is lowered from the ground potential to a negative potential −Vs/2 (V).

At this time, to establish a stable address discharge, a sub-scan pulse SSC is applied to the scan electrodes such as Y2, Y4 and Y5 adjacent to the addressed scan electrodes such as Y3. The sub-scan pulse SSC is a pulse which is lowered from a positive potential +Vs/2 (V) to the ground potential.

Incidentally, the scan electrodes such as Y3, having been addressed, will be kept at the ground potential during the subsequent second address period Ta2 and third address period Ta3.

Next, during the second address period Ta2, upon applying a pulse AP of positive potential Va to the address electrode Aj, the scan pulse SC is sequentially applied to the scan electrodes such as Y4 for addressing.

At this time, to establish a stable address discharge, the sub-scan pulse SSC is applied to the scan electrodes such as Y5 adjacent to the addressed scan electrodes such as Y4. Incidentally, since the neighboring scan electrode Y3 has been addressed as described above, the scan electrode Y3 is kept at the ground potential.

Since the scan electrodes such as Y4 have been addressed, the scan electrodes such as Y4 are kept at the ground potential during the subsequent third address period Ta3.

Next, during the third address period Ta3, upon applying the pulse AP of positive potential Va to the address electrode Aj, the scan pulse SC is applied sequentially to the scan electrodes such as Y5 and Y2 for addressing. At this time, since the neighboring scan electrodes such as Y3 and Y4 have been addressed, the scan electrodes such as Y3 and Y4 are kept at the ground potential.

Effects provided by dividing the address period Ta for addressing will be described below. There is a possibility that temperature or an electric field neutralize the wall charges formed during the reset period Tr, thereby causing the wall charges to disappear during the address period Ta. The wall charges are easily neutralized with the scan electrode Yi being brought to the ground potential during the address period Ta, whereas the wall charges are not neutralized easily with the scan electrode Yi being at a positive potential.

Suppose all the display lines are sequentially scanned during the non-divided address period Ta. In this case, the display lines that are scanned later cause the scan electrode Yi corresponding thereto to be held at the ground potential for a longer time. This causes the wall charges to disappear more easily and makes addressing more difficult. In this embodiment, as shown in FIG. 6, when the odd-numbered scan electrodes such as Y3 are addressed during the first half address period Ta1, the even-numbered scan electrodes such as Y2 and Y4 are then brought to the positive potential 606, 607, thereby sustaining the wall charges. This makes it possible to stably address the even-numbered scan electrodes such as Y2 and Y4 during the second half address period Ta2.

That is, as the number of subdivisions of the address period Ta increases, a reduced amount of wall charges is allowed to disappear. However, an excessive number of subdivisions would make control complicated. It is sufficient to divide the address period Ta into two as shown in FIG. 6 so long that the wall charges can be prevented from disappearing.

As described above, the plasma display according to this embodiment includes an address electrode for scanning and addressing a plurality of display cells, and a scan electrode for establishing an address discharge between the address electrode and the scan electrode by addressing. The plasma display also includes a common electrode for establishing a sustain discharge between the scan electrode and the common electrode to display an image at the display cells, and a scan driver for supplying a voltage to the scan electrode so as to scan a plurality of display cells upon addressing during a plurality of divided periods. Upon addressing, the scan driver lowers the potential of the scan electrode adjacent to the scan electrode that corresponds to the addressed address electrode.

The potential of the neighboring scan electrode is lowered upon producing an address discharge during the address period Ta, but raised during the other period. This makes it possible to produce a stable address discharge and sustain the stable wall charges formed during the reset period Tr. Consequently, stable wall charges can be formed during the address period Ta and as a result, an image can be displayed during the sustain period Ts. In addition, the wall charges disappear depending on temperature; however, this embodiment makes it possible to prevent the wall charges from disappearing. This causes the wall charges to be less dependent upon temperature, thereby allowing a stable image to be displayed.

Incidentally, in the foregoing, an example has been given in which the potential of both the scan electrodes adjacent to the scan electrode corresponding to the addressed address electrode is varied; however, the present invention is not limited thereto. As neighboring scan electrodes, the potential of which is varied, only the scan electrode may be employed which is adjacent to the common electrode that establishes a sustain discharge between the common electrode and the scan electrode corresponding to the addressed address electrode. That is, as shown in FIG. 7, upon addressing the scan electrode Y3, only the scan electrode Y2 may be lowered from the positive potential 606 to the ground potential 601, while the scan electrode Y4 is kept at the positive potential 607. This also provides the same effect. The reason is as follows. While the neighboring common electrode X3 for producing a sustain discharge is at the positive potential 602 relative to the addressed scan electrode Y3, the neighboring common electrode X4 is at the ground potential 604. Thus, it is not always necessary to vary the potential of the scan electrode Y4.

As described above, the number of subdivisions of the address period Ta is not restricted. At this time, the potential of each of both the scan electrodes adjacent to the addressed scan electrode may be varied. Alternatively, the potential of both neighboring scan electrodes may be varied or the potential of any one of the neighboring scan electrodes may be varied. In any case, what is required is to vary the potential of a scan electrode adjacent to the addressed scan electrode.

Incidentally, as the present invention may be embodied in several forms without departing from the scope of essential characteristic features thereof, it is to be understood that the aforementioned embodiment, although having been described specifically, are therefore illustrative and not restrictive.

As described above, according to this embodiment, upon addressing a scan electrode, it is possible to vary the potential of a neighboring scan electrode adjacent to the scan electrode between a period for establishing an address discharge and another period, during an address period. The potential is lowered during the address discharge period, but raised during the other period. This makes it possible to produce a stable address discharge and sustain the stable wall charges thereby formed.

Furthermore, temperature can cause the wall charges to disappear; however, the present invention makes it possible to prevent the wall charges from disappearing. This allows the wall charges to be less dependent on temperature, thereby making it possible to display a stable image.

What is claimed is:

1. A plasma display comprising:

a plurality of scan electrodes;

a plurality of address electrodes to establish address discharges between said address electrodes and said scan electrodes during an address period;

a plurality of common electrodes to establish sustain discharges between said scan electrodes and said common electrodes to display an image; and a scan driver to supply voltages to scan the plurality of the scan electrodes during the address period, said address period is divided into first second half address, wherein said scan driver scans said scan electrodes in individual succession and, during the first half address period, when scanning a selected scan electrode and changing the potential of an even line scan electrodes thereof, said scan driver varies the potentials of respective adjacent scan electrodes in correspondence with the changed potential of the scanned and selected scan electrode.

2. The display according to claim 1, wherein said scan driver varies potentials of both scan electrodes adjacent to said selected scan electrode that is being scanned.

3. The display according to claim 1, wherein said scan driver varies the potentials of the scan electrodes adjacent to the common electrode to establish sustain discharge with said selected scan electrode that is being scanned.

4. The display according to claim 3, wherein, during the address period, said scan driver adjusts the potentials of said scan electrodes adjacent to said selected scan electrode that is being scanned to ground potentials.

5. The display according to claim 4, wherein, during the address period, said scan driver varies the potentials of said adjacent scan electrodes adjacent to said selected scan electrode that is being scanned from said positive potentials to said ground potentials.

6. The display according to claim 5, wherein, during the address period, said scan driver adjusts said selected scan electrode that is being scanned to negative potentials.

7. The display according to claim 6, further comprising:

a common electrode driver to adjust the potential of the common electrode to the positive potential, said common electrode serving to establish said sustain discharges with the selected scan electrode that is being scanned during the address period.

8. The display according to claim 7, wherein said scan driver adjusts a potential of the selected scan electrode that is being scanned to the negative potential during the address period, and, thereafter, holds the potential of said selected scan electrode that is being scanned at said ground potential until ending of scanning of remaining scan electrodes.

9. The display according to claim 5, wherein, during the address period, said scan driver varies the potentials of said adjacent scan electrodes adjacent to said selected scan electrode, which is being scanned, to ground potentials.

10. The display according to claim 9, wherein, during the address period, said scan driver varies the potentials of said adjacent scan electrodes adjacent to said selected scan electrode that is being scanned from said positive potentials to said ground potentials.

11. The display according to claim 10, wherein, during the address period, said scan driver adjusts the potential of the selected scan electrode that is being scanned to a negative potential.

12. The display according to claim 1, wherein said scan driver supplies a voltage to said scan electrodes so as to scan the plurality of scan electrodes during two split periods during the address period.

13. The display according to claim 12, wherein said scan driver divides display lines into even-numbered lines and odd-numbered lines for scanning.

14. A method of driving a plasma display comprising a plurality of scan electrodes, a plurality of address electrodes establishing address discharges between said address electrodes and said scan electrodes by addressing, and a plurality of common electrodes establishing sustain discharges between said scan electrodes and said common electrodes to display an image at display cells, said method comprising;

a plurality of address electrodes to establish address discharges between said address electrodes and said scan electrodes during an address period;

said address period is divided into first and second half address, scanning, and thereby selecting, said scan electrodes to be scanned in individual succession; and during an address period, when scanning a selected scan electrode the first half address period and changing the potential of an even line scan electrodes thereof, varying the potentials of respective adjacent scan electrodes in correspondence with the changed potential of the scanned and selected scan electrode.

15. The method according to claim 14, wherein said potential of said adjacent scan electrode adjacent to said scan electrode that is being scanned is varied from positive potentials to ground potentials.

16. A plasma display comprising:

a plurality of scan electrodes;

a plurality of address electrodes to establish address discharges between respective ones of the address electrodes and of the scan electrodes during an address period;

a plurality of common electrodes to establish sustain discharges between respective ones of the scan electrodes and of the common electrodes to display an image at display cells; and said address period is divided into first and second half address a scan driver to supply a voltage to the plurality of scan electrodes so as to scan the plurality of the scan electrodes in individual secession and, during an address period when scanning a selected scan electrode of the first half of address period and changing the potential thereof, said scan driver varies the potentials of respective adjacent scan electrodes in correspondence with the changed potential of an even line scan electrodes scanned and selected scan electrode and, where scanning a selected scan electrode.

17. A method of driving a plasma display comprising a plurality of scan electrodes, a plurality of address electrodes to establish address discharges between respective ones of the address electrodes and the scan electrodes by addressing, and a plurality of common electrodes to establish sustain discharges between respective ones of the scan electrodes and of the common electrodes to display an image at display cells, the method comprising:

an address period is divided into first and second half address scanning said scan electrodes in individual session and during an address period, when scanning a selected scan electrode of the first half of address period and changing the potential of an even line scan electrodes thereof, varying the potentials of respective adjacent scan electrodes in correspondence with the changed potential of the scanned and selected scan electrode.

* * * * *

UNITED STATES PATENT AND TRADEMARK OFFICE

CERTIFICATE OF CORRECTION

PATENT NO. : 7,023,403 B2
APPLICATION NO. : 09/983945
DATED : April 4, 2006
INVENTOR(S) : Noriaki Setoguchi et al.

It is certified that error appears in the above-identified patent and that said Letters Patent is hereby corrected as shown below:

Column 8, Line 60, after " display" insert --,--.

Column 9, Line 3, after "first" insert --and--.

Column 9, Line 43, "claim 5," should read --claim 1--.

Column 10, Line 53, after "address" insert --,--.

Signed and Sealed this

Thirtieth Day of January, 2007

JON W. DUDAS
*Director of the United States Patent and Trademark Office*